US011521813B2

(12) United States Patent
Gualdron Florez

(10) Patent No.: US 11,521,813 B2
(45) Date of Patent: Dec. 6, 2022

(54) DISCONNECTING SWITCHGEAR FOR ELECTRICAL SAFETY PROCEDURE AND COMPLIANCE WITH THE FIVE GOLDEN RULES OF ELECTRICAL SAFETY VIA A SINGLE SWITCH

(71) Applicant: Jesus Gualdron Florez, Bucaramanga (CO)

(72) Inventor: Jesus Gualdron Florez, Bucaramanga (CO)

( * ) Notice: Subject to any disclaimer, the term of this patent is extended or adjusted under 35 U.S.C. 154(b) by 0 days.

(21) Appl. No.: 17/618,544

(22) PCT Filed: Jun. 9, 2020

(86) PCT No.: PCT/CO2020/000006
§ 371 (c)(1),
(2) Date: Dec. 13, 2021

(87) PCT Pub. No.: WO2020/253891
PCT Pub. Date: Dec. 24, 2020

(65) Prior Publication Data

US 2022/0359135 A1 Nov. 10, 2022

(30) Foreign Application Priority Data

Jun. 15, 2019 (CO) ..... 20190006270

(51) Int. Cl.
*H01H 19/46* (2006.01)
*H01H 19/04* (2006.01)
*H01H 19/14* (2006.01)

(52) U.S. Cl.
CPC ..... *H01H 19/46* (2013.01); *H01H 19/04* (2013.01); *H01H 19/14* (2013.01)

(58) Field of Classification Search
CPC ..... H01H 19/46; H01H 19/04; H01H 19/14; H01H 31/003; H01H 31/32; H01H 33/022;
(Continued)

(56) References Cited

U.S. PATENT DOCUMENTS 6,194,983 B1 * 2/2001 Bogdon ..... H01H 71/56 335/73
2003/0034330 A1 2/2003 Osterholm et al.
(Continued)

FOREIGN PATENT DOCUMENTS

CN 204424105 U 6/2015
DE 102004015386 A1 10/2004
(Continued)

OTHER PUBLICATIONS

International Search Report and Written Opinion for Application PCT/CO2020/000006; dated Oct. 5, 2020; 6 pp.
(Continued)

*Primary Examiner* — Ahmed M Saeed
(74) *Attorney, Agent, or Firm* — Armstrong Teasdale LLP

(57) ABSTRACT

A disconnecting switchgear has three mutually exclusive positions II-0-I, with position II energizing the load circuit, position 0 de-energizing the load circuit and position I grounding the circuit, which reduces the electrical risk when interacting with an electrical panel. The switchgear includes a control interconnected with a body, where the control includes a gripping mechanism with an electrical labelling element, an extension mechanism, a locking mechanism and indicator labels; the body includes a group of external electrical conductors or connection terminals, a group of internal electrical conductors or poles, an earth short-circuit electrical conductor, displays of electrical quantities, luminous indicators, and sight glasses for viewing moving poles;
(Continued)

electrical conductors and electrical contacts interconnected with a drive shaft and the latter to a power-transmission mechanism.

28 Claims, 16 Drawing Sheets

(58) Field of Classification Search
CPC .... H01H 1/38; H01H 1/50; H01H 2009/0292; H01H 3/42; H01H 31/02; H01H 33/121; H01H 33/125; H01H 33/16; H01H 33/6661; H01H 33/886; H01H 33/91
See application file for complete search history.

(56) References Cited

U.S. PATENT DOCUMENTS

| | | | | |
|---|---|---|---|---|
| 2015/0318687 | A1* | 11/2015 | Lagree | H02H 9/02 361/93.1 |
| 2016/0247652 | A1* | 8/2016 | Devine | H01H 71/128 |

FOREIGN PATENT DOCUMENTS

| | | | |
|---|---|---|---|
| EP | 2787519 | A1 | 10/2014 |
| WO | 2011161121 | A1 | 12/2011 |

OTHER PUBLICATIONS

Written Opinion for Application PCT/CO2020/000006; dated Oct. 5, 2020; 5 pp.

* cited by examiner

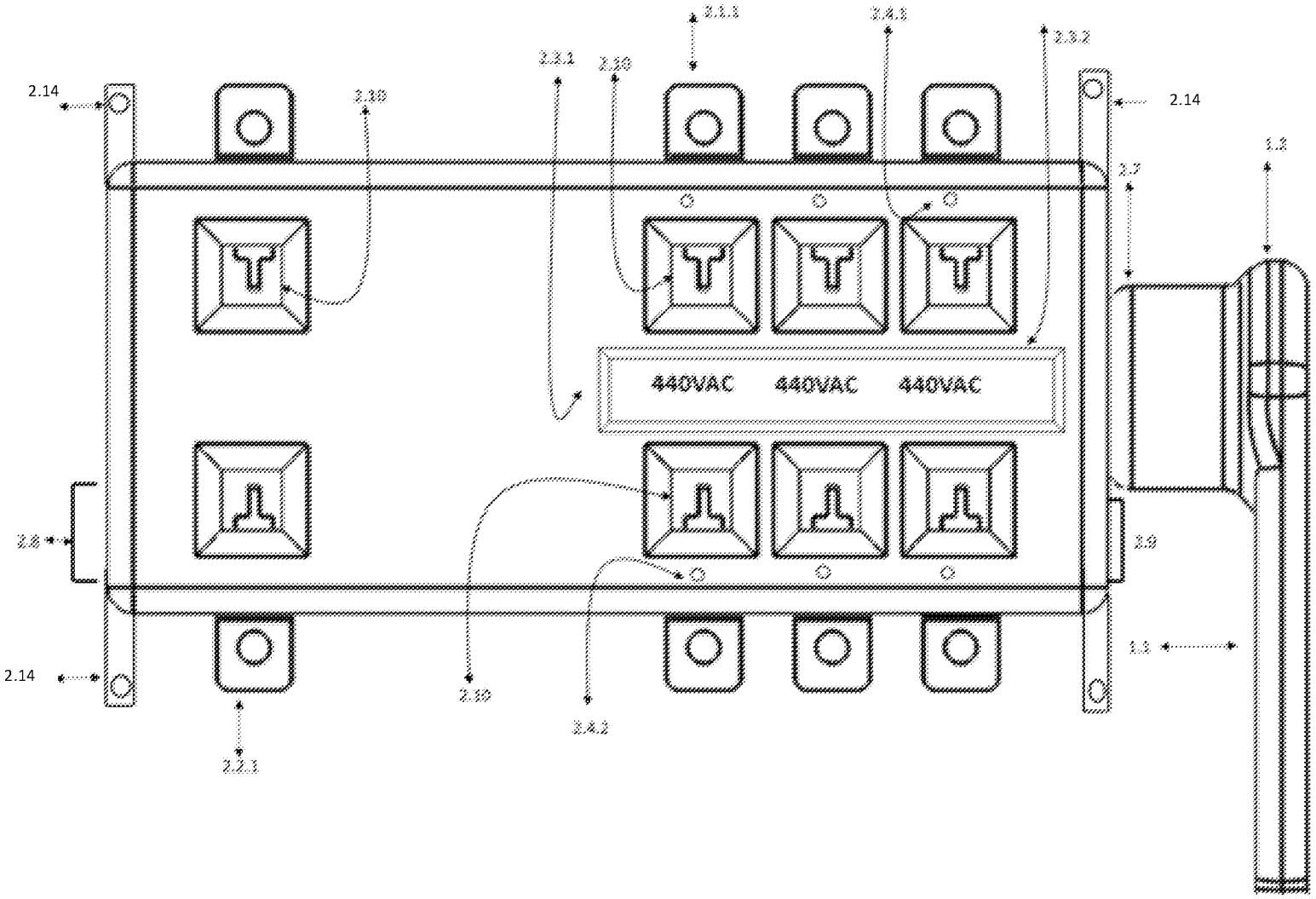
Figure 1.1

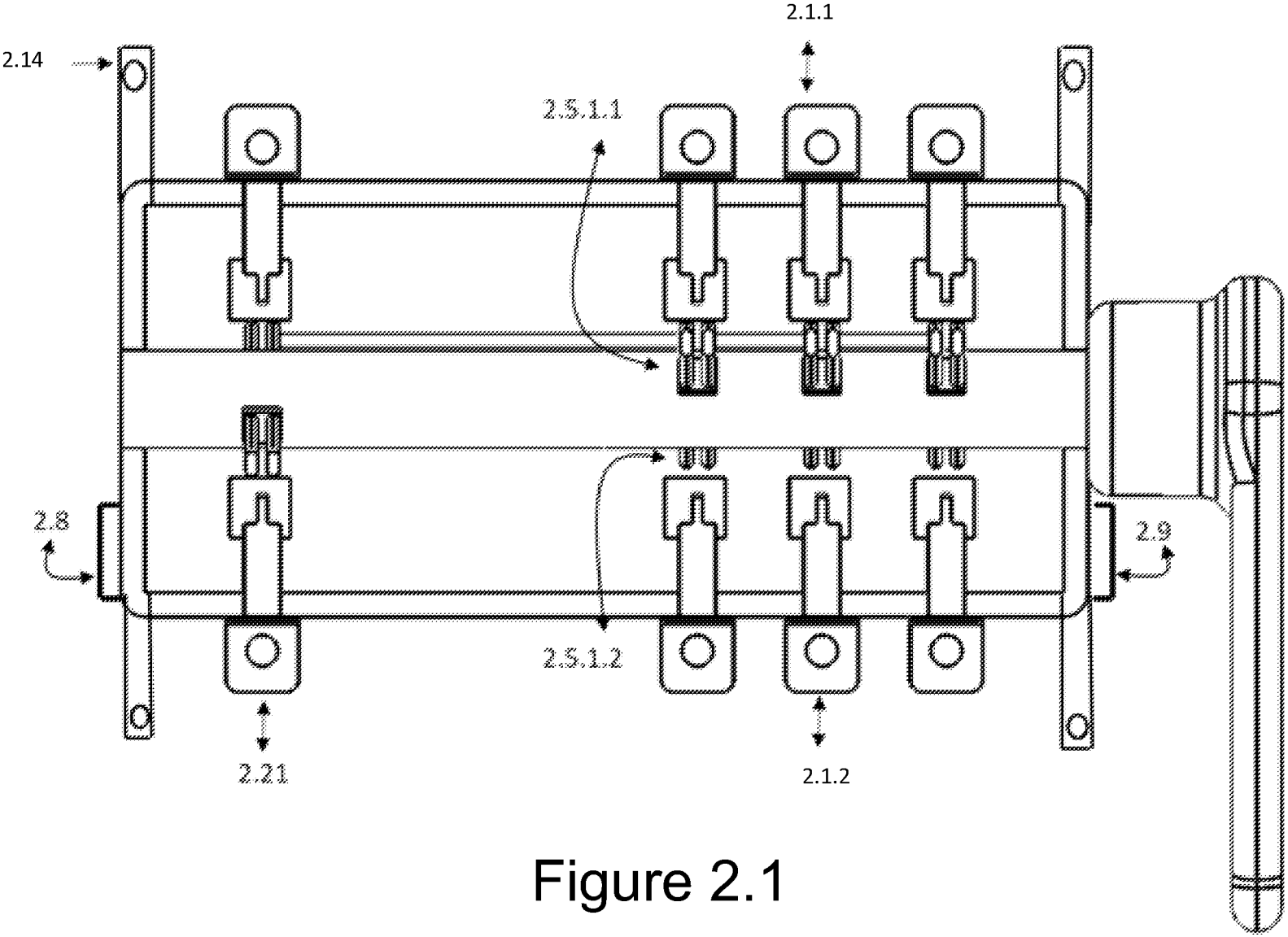
Figure 2.1

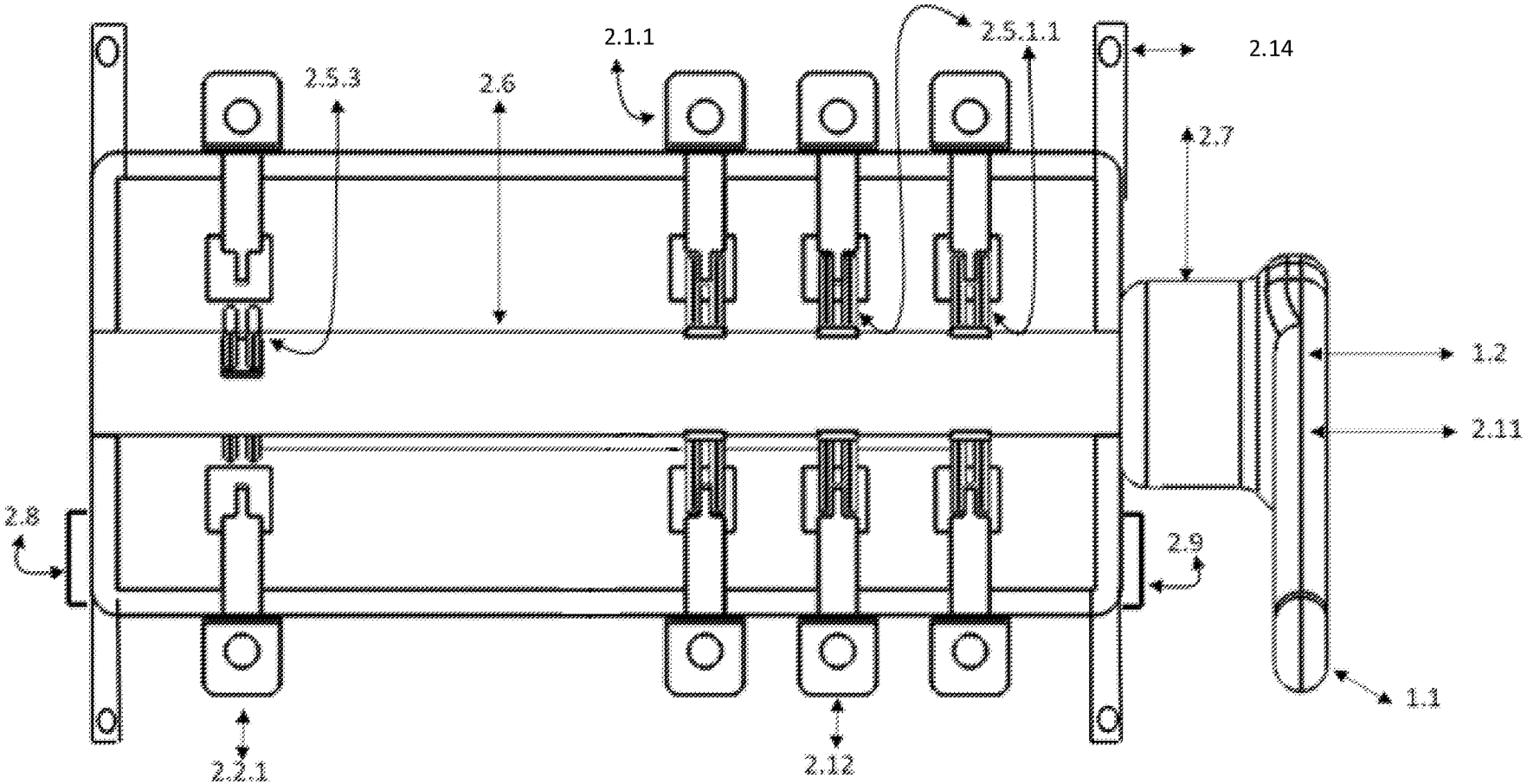
Figure 3.1

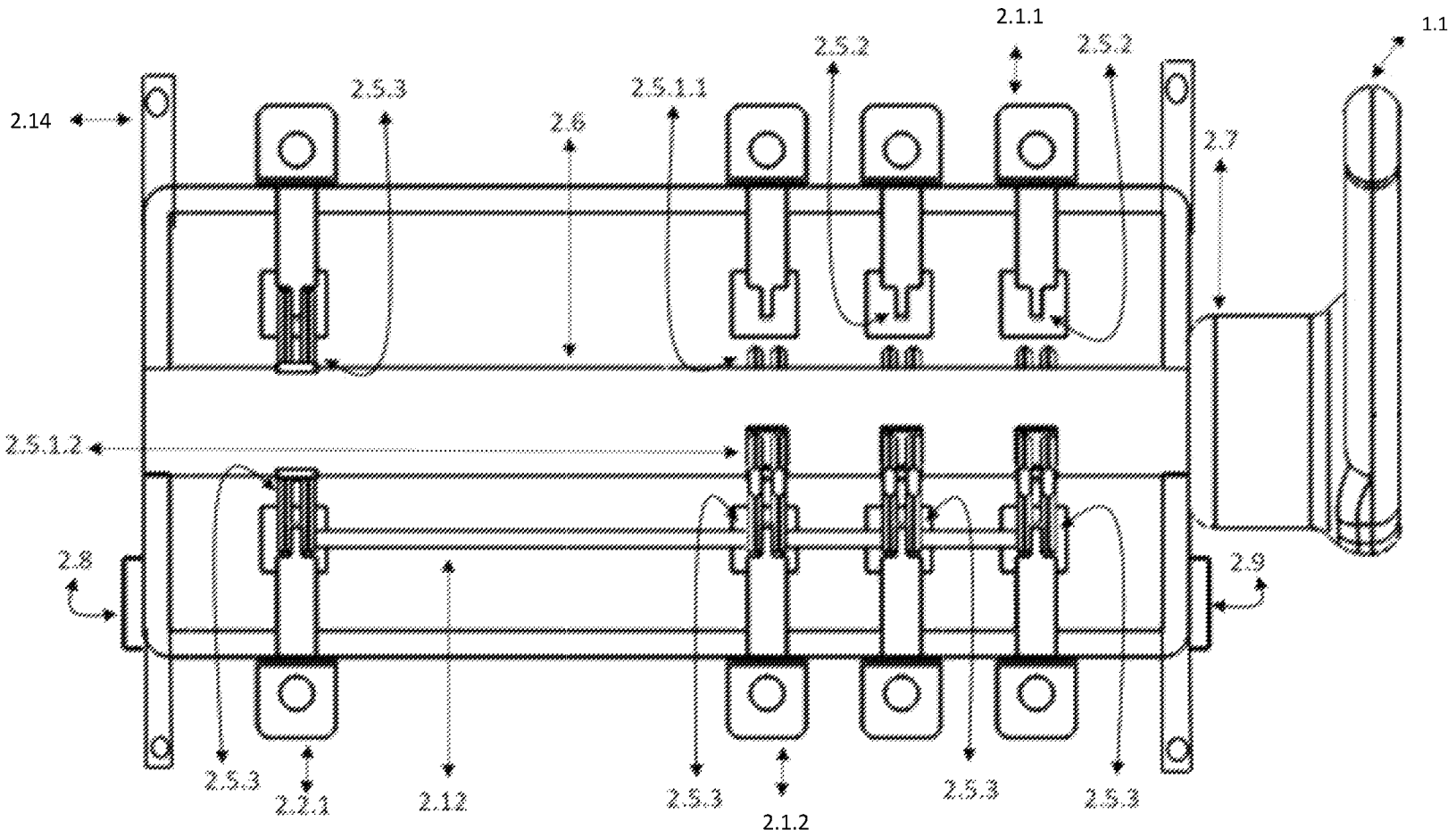
Figure 4.1

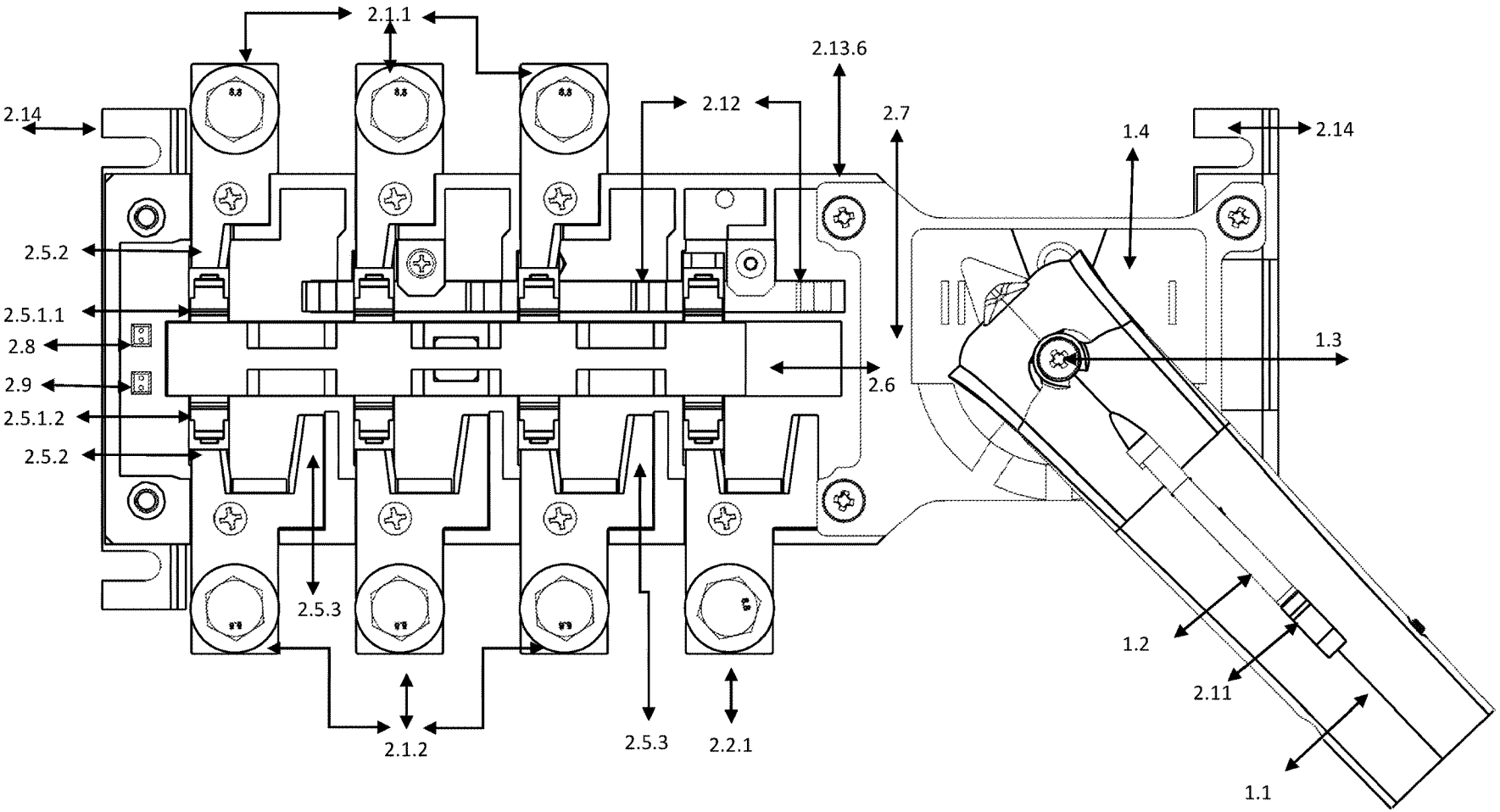
Figure 6.1

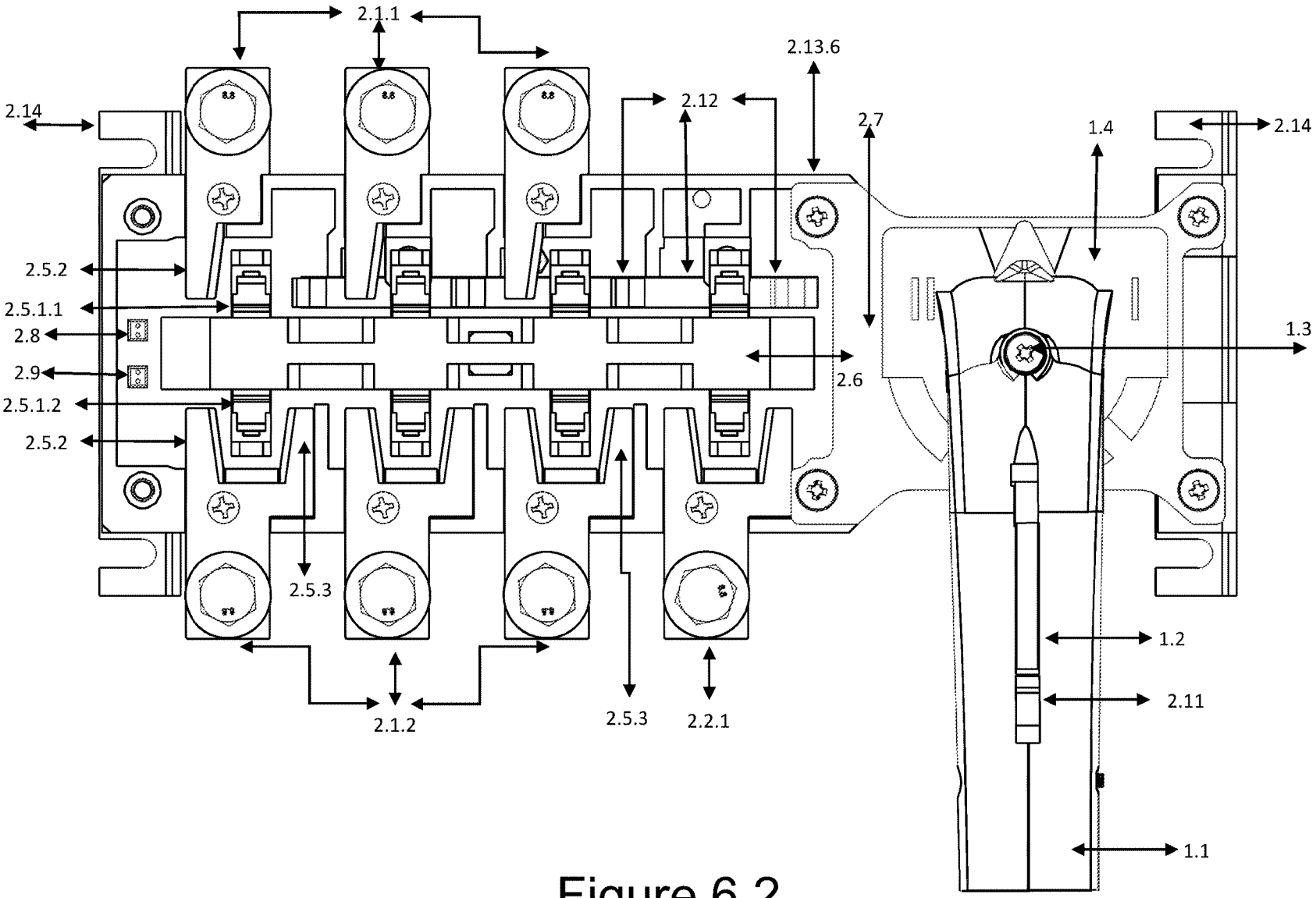
Figure 6.2

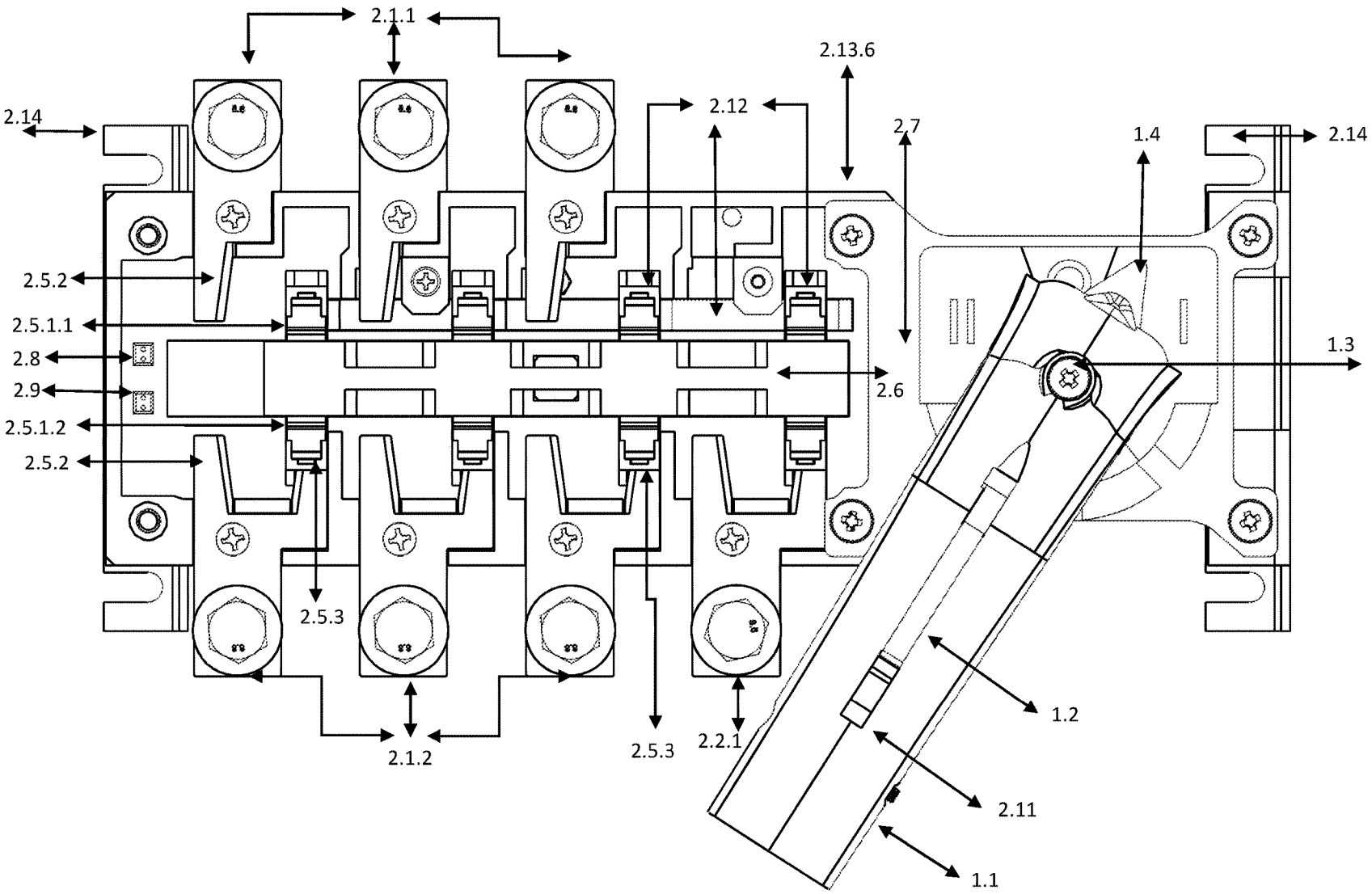
Figure 6.3

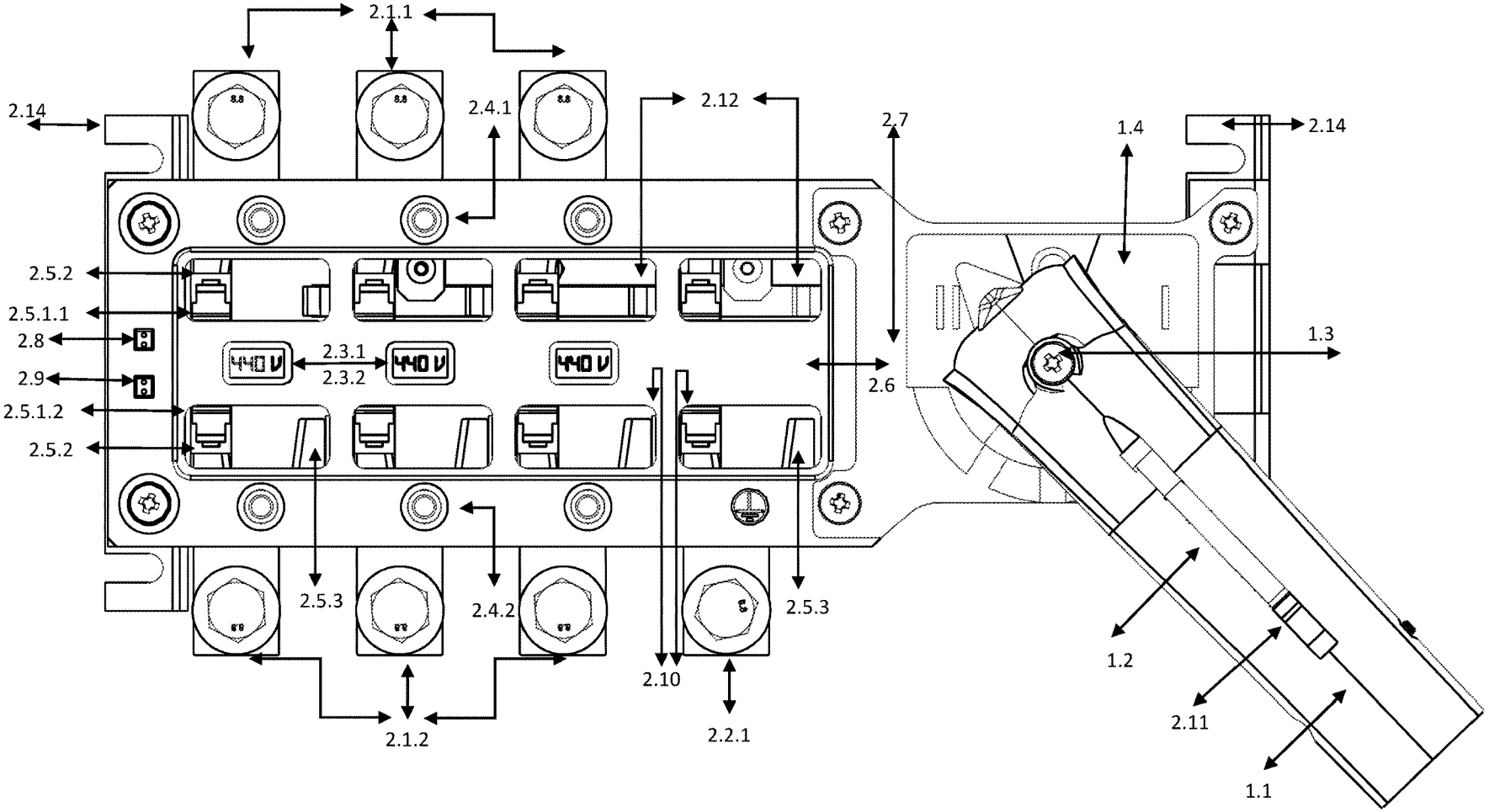
Figure 6.4

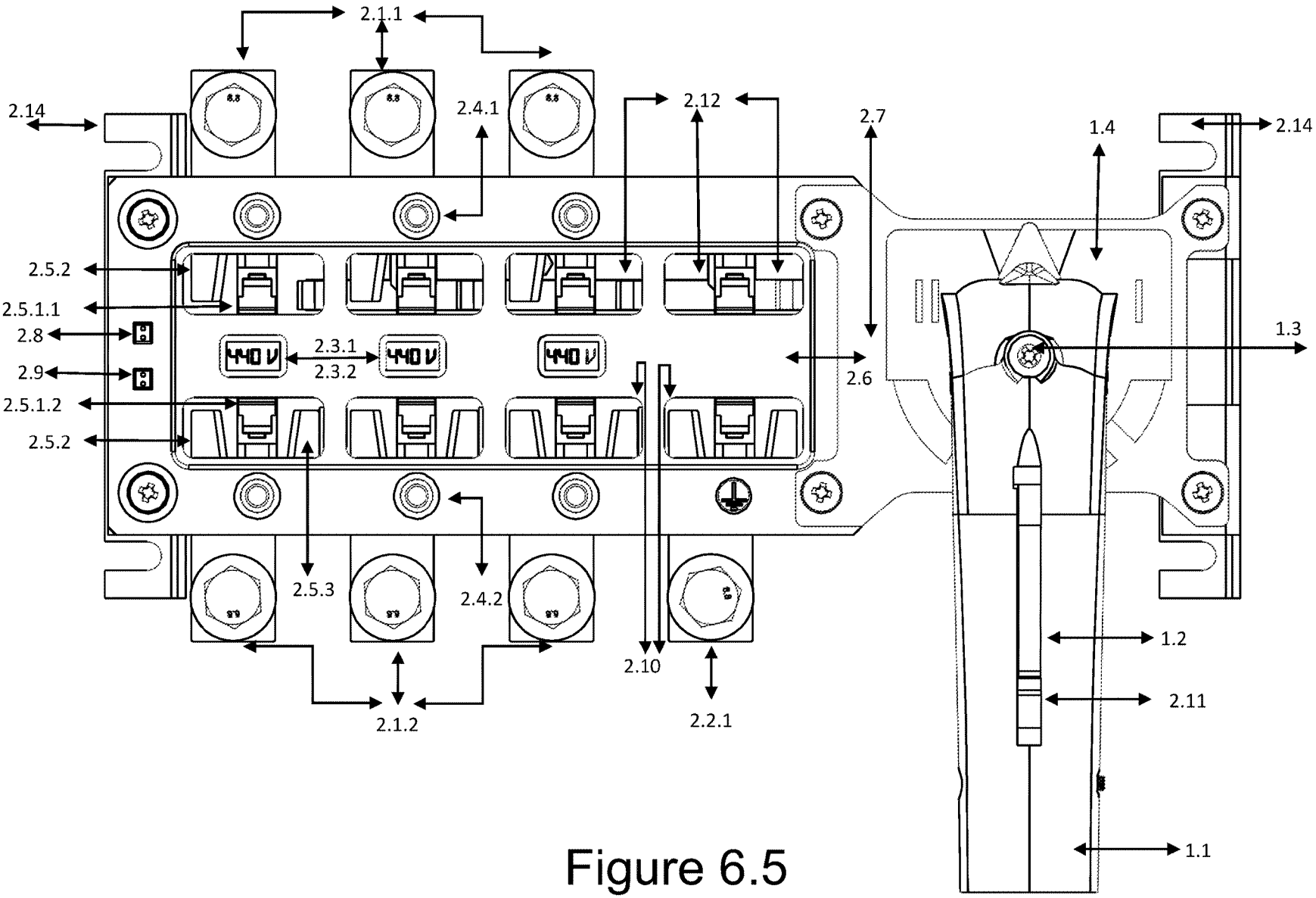
Figure 6.5

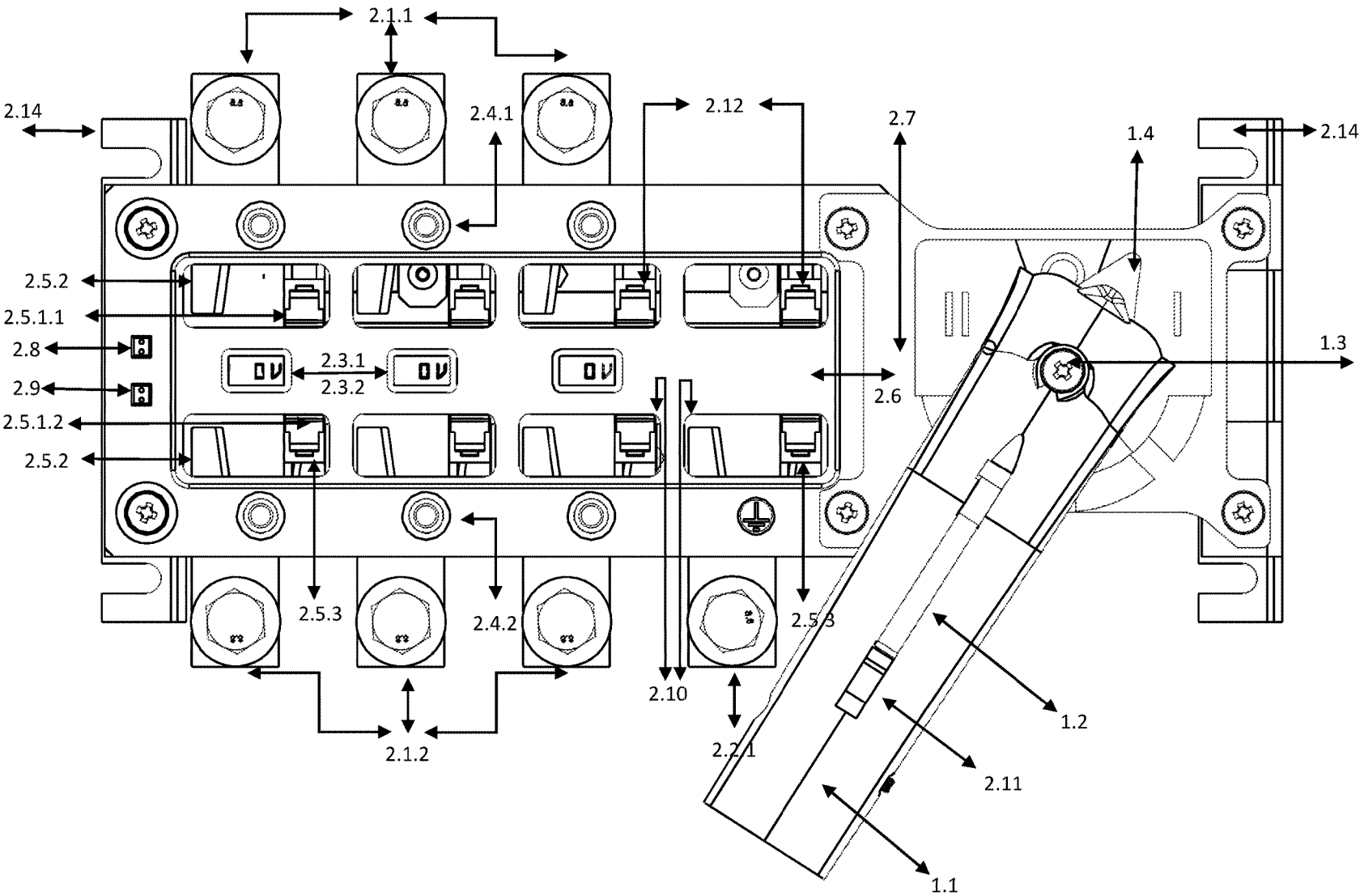
Figure 6.6

DISCONNECTING SWITCHGEAR FOR ELECTRICAL SAFETY PROCEDURE AND COMPLIANCE WITH THE FIVE GOLDEN RULES OF ELECTRICAL SAFETY VIA A SINGLE SWITCH

CROSS-REFERENCE TO RELATED APPLICATIONS

This application is a U.S. National Phase Application of PCT/CO2020/000006 filed Jun. 9, 2020, which claims the benefit of Colombia Patent Application No. 2019/0006270 filed Jun. 15, 2019. The content of these applications is hereby expressly incorporated by reference in their entirety.

INVENTION FIELD

The present invention relates, in general terms, to the development of systems and devices in the field of electrical engineering. More specifically, the invention refers to equipment designed for the mitigation of electrical risk in the intervention of switchboards or electrical infrastructure, including compliance with the five golden rules of electrical safety.

INVENTION BACKGROUND

The intervention of electrical panels or installations at high voltage, medium voltage, or low voltage levels, for maintenance work, equipment replacement, equipment revision, equipment inspection, etc., entails risks. The mere fact of opening an electrical panel implies exposure to electrical risks, unless good industrial and operational practices are followed to mitigate them.

To mitigate the electrical risk in the intervention of panels or electrical infrastructure, the five golden rules of electrical safety must be considered. These golden rules are contemplated in various national and international technical standards, labor ministry resolutions, electrical regulations and in the electrical safety manual of each company. The five golden rules are as follows:

- Make visible the disconnection of all voltage sources (physically see the internal position of the poles): by means of switches and disconnectors, in such a way as to ensure the impossibility of their sudden closure. In those devices in which the disconnection cannot be visible, there must be a device that guarantees that the cut-off is effective.
- Lockout or blocking: Operation that prevents the reconnection of the device on which the visible disconnection has been made; it allows keeping it in the determined position and prevents its sudden closure or resetting. For its materialization it is possible to use a lockout padlock. In cases where mechanical locking is not possible, equivalent measures must be taken, such as, for example, removing removable elements from their housing.
- Check the absence of voltage on each phase. This is conducted with a voltage detector suitable for the nominal voltage level of the grid, which must be tested before and after each use.
- Grounding and short-circuiting of all possible voltage sources that affect the work area. This is the operation of connecting all the phases of an installation by means of a suitable equipotential bonding of bridge structures that has previously been connected to earth. If they are not effectively grounded, all the conductors or parts of the circuit are considered as if they were energized at their rated voltage.
- Signposting and delimiting the work area. It is the operation of conveying the message that must be complied with to prevent the risk of accident by means of signs with phrases or symbols.

Currently, for low voltage circuits in switchboards (0 VAC-1000 VAC) in low and medium voltage overhead circuits, there is no integral device that allows compliance with the five golden rules of electrical safety via a single equipment and without interaction with energized parts by the people who operate or intervene in the systems.

Companies, engineers, technicians usually perform a procedure for compliance with the five golden rules, which involves time, cost, and risk, in addition to requiring a qualified person in the electrical sector to perform the work, since the electrical panel door is opened or if the infrastructure is visible, a device is used directly on the electrical infrastructure to verify the absence of voltage. On the other hand, blocking and grounding are done from the internal part of the board, physically intervening, and interacting with the parts and components that may be energized or de-energized; or if the infrastructure is visible as an overhead line, the physical and direct intervention of the electrical infrastructure must be performed by technical personnel.

Several companies have electrical load break switches-disconnectors that by themselves do not fulfill the safety-focused function of the electrical safety five golden rules. The existing disconnectors are focused on opening and closing circuits (on/off) or switching sources (grid-generator, grid-grid, Source 1+Source 2). For such equipment to comply with the 5 golden rules, they must be combined or complemented with external equipment and thus reach a solution that allows compliance with the 5 golden rules of electrical safety.

In conclusion, so far there is no evidence at commercial or technical level of an all-in-one equipment, developed to comply with the 5 golden rules of electrical safety without the need to open the board, or interact directly with parts or components of the electrical infrastructure that may be energized or de-energized.

INVENTION PURPOSE

The purpose of the present invention is to provide an electrical system for the intervention of panels or electrical infrastructure, through the development of a compact equipment that allows compliance with the 5 golden rules of electrical safety (visible disconnection, blocking, verification of voltage absence, grounding, demarcation) via a single equipment, without the need to perform the opening of electrical panels or procedures on overhead electrical infrastructure, or interact directly with energized parts.

Another purpose of the invention is to provide equipment that mitigates the electrical hazards of personnel interacting with electrical infrastructure in their routine activities since they do not interact with energized parts directly.

Another purpose of the invention is to improve times and costs in the establishment of electrically safe zones.

BRIEF DESCRIPTION OF THE FIGURES

For a better understanding of the present invention refer to the figures accompanying this document. These figures illustrate, as an example, only one embodiment of the invention equipment, but without limiting its scope to other possible configurations. In such figures, the reference codes indicate identical or similar elements.

FIG. 1.1 presents a front external view of another embodiment of invention model B.

FIG. 2.1 presents a front internal view in position 0 of another embodiment of the invention model B.

FIG. 3.1 presents a front internal view in position II of another embodiment of invention model B.

FIG. 4.1 presents a front internal view in position I of another embodiment of invention model B.

FIG. 6.1 presents an internal front view in position II of the embodiment of the invention shown in FIG. 6.

FIG. 6.2 presents an internal front view in position 0 of the embodiment of the invention shown in FIG. 6.

FIG. 6.3 presents an internal front view in position I of the embodiment of the invention shown in FIG. 6.

FIG. 6.4 presents an external front view in position II of the embodiment of the invention shown in FIG. 6.

FIG. 6.5 presents an external front view in position 0 of the embodiment of the invention shown in FIG. 6.

FIG. 6.6 presents an external front view in position I of the embodiment of the invention shown in FIG. 6.

LIST OF ELEMENTS OF THE INVENTION

Figure 1:
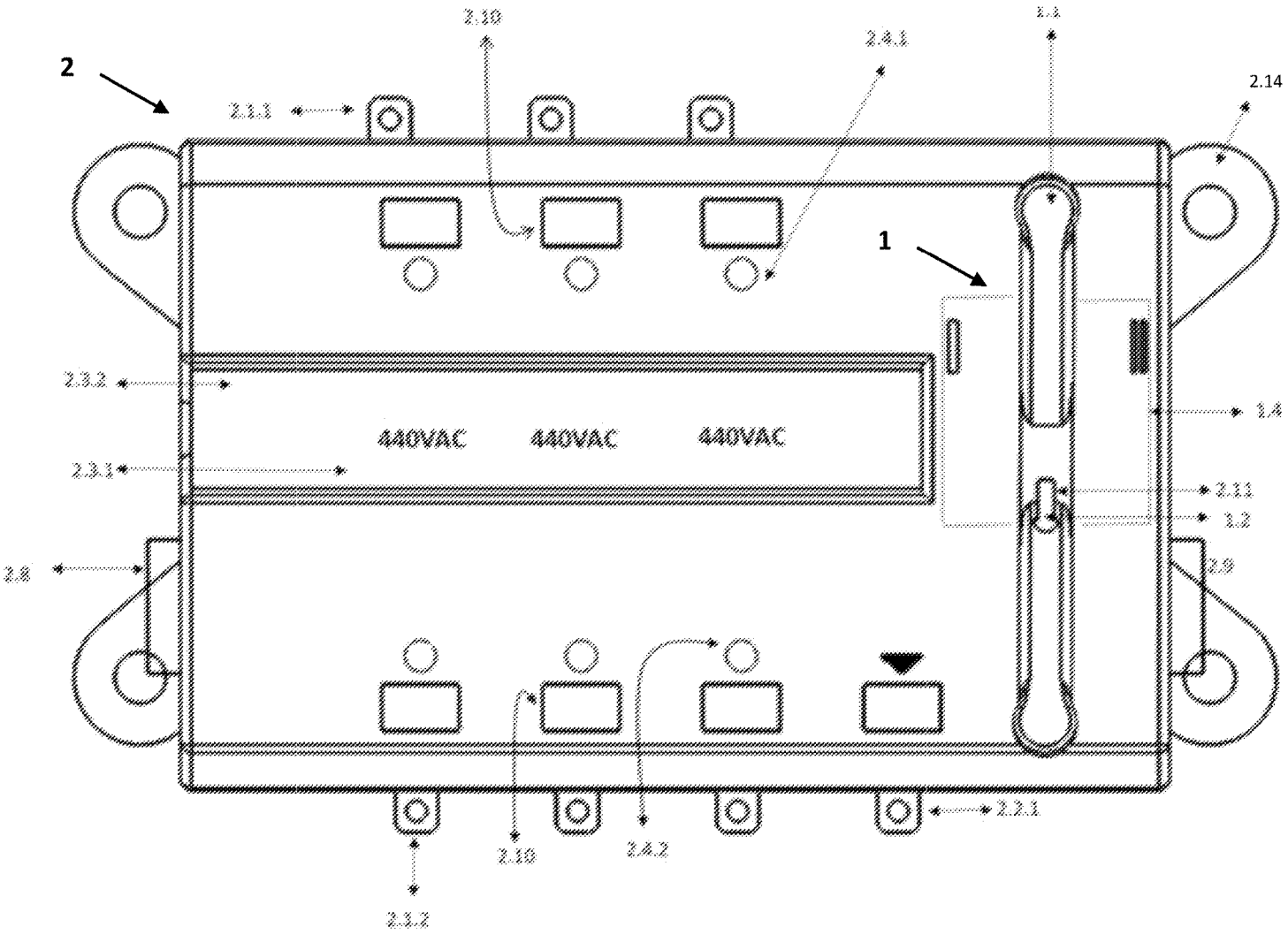
FIG. 1 shows a front external view of model A equipment.

The following list corresponds to the set of essential elements that are part of an embodiment of the present invention.

The reference code included in the figure set is indicated on the front of each element for easy identification.

| | |
|---|---|
| Control | 1 |
| Handle or gripping mechanism | 1.1 |
| Locking mechanism | 1.2 |
| Extension mechanism | 1.3 |
| Switch position indicator label | 1.4 |
| Body | 2 |
| External electrical terminals or conductors | 2.1 |
| Electrical input terminals or conductors | 2.1.1 |
| Electrical output terminals or conductors | 2.1.2 |
| Electrical grounding terminals or conductors | 2.2 |
| Fixed electrical grounding terminals or conductors | 2.2.1 |
| Electrical variables display | 2.3 |
| Display | 2.3.1 |
| Connecting accessory | 2.3.2 |
| Voltage indicator lights | 2.4 |
| Upper indicator lights | 2.4.1 |
| Lower indicator lights | 2.4.2 |
| Internal electrical poles or conductors | 2.5 |
| Internal movable electric poles or conductors | 2.5.1 |
| Internal input movable electric poles or conductors | 2.5.1.1 |
| Output poles or movable electric conductors | 2.5.1.2 |
| Transition poles or transition conductors | 2.5.2 |
| Internal electrical grounding poles or conductors | 2.5.3 |
| Drive shaft for internal pole movement | 2.6 |
| Force transmission system | 2.7 |
| Electrical auxiliary contacts for position indication | 2.8 |
| Pre-cutting electrical contacts | 2.9 |
| Peepholes for movable pole display | 2.10 |
| Element for electrical labelling location | 2.11 |
| Electrical grounding short-circuit conductor | 2.12 |

-continued

| | |
|---|---|
| Covers | 2.13 |
| Front cover | 2.13.1 |
| Top cover | 2.13.2 |
| Bottom cover | 2.13.3 |
| Right side cover | 2.13.4 |
| Left side cover | 2.13.5 |
| Rear cover | 2.13.6 |
| Fasteners | 2.14 |

BRIEF DESCRIPTION OF THE INVENTION

The present invention corresponds to a load break switch equipment for electrical panels and electrical infrastructure for implementation of electrical safety procedures and compliance with the five golden rules of electrical safety, comprising:

A control (1) consisting of: —a gripping mechanism (1.1) interconnected with an extension mechanism (1.3) or directly to the body (2), —a locking mechanism (1.2) embedded in the gripping mechanism (1.1) or in the body 2; and position indicators (1.4) interconnected to the gripping mechanism (1.1) or to the body 2.

A body (2) comprising:

electrical conductors (2.1.1), (2.1.2), (2.2.1), (2.5.1.1), (2.5.1.2), (2.5.2), (2.5.3) (2.12); wherein the electrical conductors (2.1.1), (2.1.2) are interconnected with displays of electrical variables (2.3), wherein such displays (2.3) are interconnected with the electrical conductors (2.1.1), (2.1.2) and are embedded in a body cover (2); wherein the electrical grounding short-circuit conductors (2.12) are interconnected with the electrical conductors (2.5.3).

indicator lights (2.4.1) interconnected to the input electrical conductors (2.1.1) and indicator lights (2.4.2) interconnected to the output electrical conductors (2.1.2) and are embedded in a body cover (2).

internal input movable electrical conductors (2.5.1.1), internal output movable electrical conductors (2.5.1.2) and internal grounding electrical conductors (2.5.3) interconnected with a drive shaft (2.6) and contained within the body 2.—The electrical grounding short-circuit conductor (2.12) is interconnected with the electrical grounding conductors (2.5.3).

besides, the drive shaft (2.6) is interconnected with a force transmission mechanism (2.7); and such force transmission mechanism (2.7) is interconnected with the extension mechanism (1.3).

auxiliary electrical contacts for position indication (2.8) and pre-cutting electrical contacts (2.9) interconnected with the drive shaft (2.6).

element for electrical labeling location (2.11) embedded in the gripping mechanism (1.1) or in some face of the body (2); in addition, in the body (2), it will have peepholes (2.10) that will allow the visual inspection of the internal position of the internal movable conductors (2.5.1.1) (2.5.1.2) and the internal movable conductors (2.5.3) from the outside to validate if the circuit is solidly energized, de-energized or solidly grounded.

covers (2.13) interconnected with each other forming a six-sided body, right side (2.13.4), left side (2.13.5), rear (2.13.6), bottom (2.13.3), top (2.13.2) and front (2.13.1); and fastening elements (2.14) connected to the rear cover (2.13.6) and to the fastening surface.

DETAILED DESCRIPTION OF THE INVENTION

This disclosure corresponds to the detailed explanation of some of the modalities of the invention and does not imply the limitation of the scope of the invention defined in the claims.

For a more complete understanding of the present invention, reference is now made to the following description in an illustrative and non-limiting manner thereof, considering it as a whole including the figures mentioned above; the reference numerals indicate identical or similar elements in the corresponding figures.

To understand the description of the invention, we have used the expression "voltage" to make reference to voltage. On the other hand, the term "terminal" will refer to electrical conductors for external connection points in the equipment; meanwhile, "poles" will refer to internal electrical conductors for internal connection points in the equipment.

The invention has the following features:

Electric load break switch with body and direct or extended rotary operating mechanism. The body shall have peepholes on some cover of the body that allow the visualization of the internal poles of the load break switch, it shall also have in its external part, a display of electrical variables and upper and lower light indicators. It shall have peepholes in the body that allow seeing the position of the internal poles to verify by visual inspection if the circuit is closed, open or grounded.

The equipment will have 3 working positions commanded from the handle, the working positions are II-0-I (2, 0 and 1), which will allow the interaction of the load break switch parts according to the position of the handle, also each position exerts an internal movement on the parts and makes the three movements different and mutually exclusive.

A. In position II (2) the load break switch equipment is closed, i.e., the movable internal poles have moved and have connected the input terminals with the output terminals allowing the flow of electric current to the load, i.e., the circuit are energized or with voltage both upstream and downstream of the load break switch. The display of electrical variables will be on and showing average values such as voltage, current and others, the indicator lights that will be on the front or any cover of the load break switch will also be on and emitting light.

B. The equipment in position 0, will allow the interruption of electric current to the load, and the voltage at the output terminals will be zero volts, but it will maintain the voltage upstream, also, the display of electrical variables will be on, but it will indicate or mark 0 volts and 0 amperes. Regarding the indicator lights, the lower ones will be off while the upper indicator lights will be on indicating the presence of voltage.

C. In position I (1): In this position, all phases that are downstream of the equipment, and that are connected to the output terminals will be internally short-circuited through the ground poles; the grounding short-circuit conductor and will be grounded to the electrical system ground through the grounding output terminal. The electrical variables display will be energized but its measurements will be zero, the upper indicator lights will be on, and the lower indicator lights will be off. They are short-circuited and grounded to the equipment's own fixed grounding terminal. The indicator will show the same as in position 0.

It is emphasized that the positions are mutually exclusive, i.e., there will be no physical connection between the input and output terminals at the time of grounding. In addition, the load break switch can be blocked in any of its positions II-0-I and passing through position 0 is mandatory to go from position II to I or vice versa.

D. The load break switch will have the input and output terminals required by the electrical system, always having a terminal for exclusive use of the grounding system, in general terms it can be applied to single-phase, two-phase, three-phase circuits with or without neutral, hexaphase circuits, or in any configuration required by the electrical system.

E. The load break switch will have the same number of poles at the input as at the output, plus 1 pole for grounding the system downstream.

F. The load break switch shall have a control (1) which shall be connected to the body of the disconnector directly or through an extension element to conduct the II-0-I movements that allow the establishment of the 5 golden rules of electrical safety.

G. The load break switch shall have a system that allows verification of the presence of voltage by means of light indicators or a display of electrical magnitudes; this display shall be an integral part of the equipment.

H. The application will be conducted in all types of electrical installations, both in cabinets and in overhead or underground electrical distribution systems.

I. The body (2) and control (1) shall be of a dielectric material, internally in the body, all electrical conducting material shall be copper, aluminum or any electrical conducting material.

J. The indication by indicator lights and the display of electrical magnitudes will be self-powered by the system itself, i.e., it will be powered by the energy provided by the system's grid.

K. The load break switch shall have a locking mechanism that allows the load break switch to be locked in any of the three positions II-0-I. This mechanism may be embedded in the control (1) or in the body (2); additionally, this mechanism shall allow the installation of a padlock to prevent sudden closure or change of position of the load break switch.

In general terms, the invention is defined as a load break switch equipment for electrical safety procedure and compliance with the 5 golden rules of electrical safety via a single equipment, comprising: a control (1) interconnected to a body (2).

The control (1) consists of: —a gripping mechanism (1.1) interconnected with an extension mechanism (1.3) or directly to the body (2), —a locking mechanism (1.2) embedded in the gripping mechanism (1.1) in the body (2); and position indicators (1.4) interconnected to the gripping mechanism (1.1) or to the body (2).

A body (2) includes:

electrical conductors (2.1.1), (2.1.2), (2.2.1), (2.5.1.1), (2.5.1.1), (2.5.1.2), (2.5.2), (2.5.3) (2.12); wherein the electrical conductors (2.1.1), (2.1.2) are interconnected with displays of electrical variables (2.3), wherein these displays (2.3) are interconnected with the electrical conductors (2.1.1), (2.1.2) and are embedded in a cover of the body (2); wherein the electrical conductors (2.12) are inside the body 2.

upper indicator lights (2.4.1) interconnected to the input electrical conductors (2.1.1) and lower indicator lights (2.4.2) interconnected to the output electrical conductors (2.1.2) and are embedded in one cover of the body (2)

internal input movable electrical conductors (2.5.1.1), internal output movable electrical conductors (2.5.1.2) and internal electrical grounding conductors (2.5.3) contained within the body 2.

electrical grounding short-circuit conductor (2.12) contained in body 2.

the drive shaft (2.6) further interconnected with a force transmission mechanism (2.7); and this force transmission mechanism (2.7) interconnected with the extension mechanism (1.3).

auxiliary electrical contacts for position indication (2.8) and pre-cutting electrical contacts (2.9) interconnected with the drive shaft (2.6).

element for electrical labelling location (2.11) embedded in the gripping mechanism (1.1) or on some face of the body (2).

It shall have peepholes (2.10) that shall allow visual inspection of the internal position of the internal movable conductors (2.5.1.1) (2.5.1.2) and the internal grounding poles or electrical conductors (2.5.3) from the outside to validate if the circuit is solidly energized, de-energized or solidly grounded.

covers (2.13) interconnected with each other forming a six-sided body, right side (2.13.4), left side (2.13.5), rear (2.13.6), bottom (2.13.3), top (2.13.2) and front (2.13.1); and the fastening elements (2.14) connected to the rear cover (2.13.6) and to the fastening surface.

Figure 2:
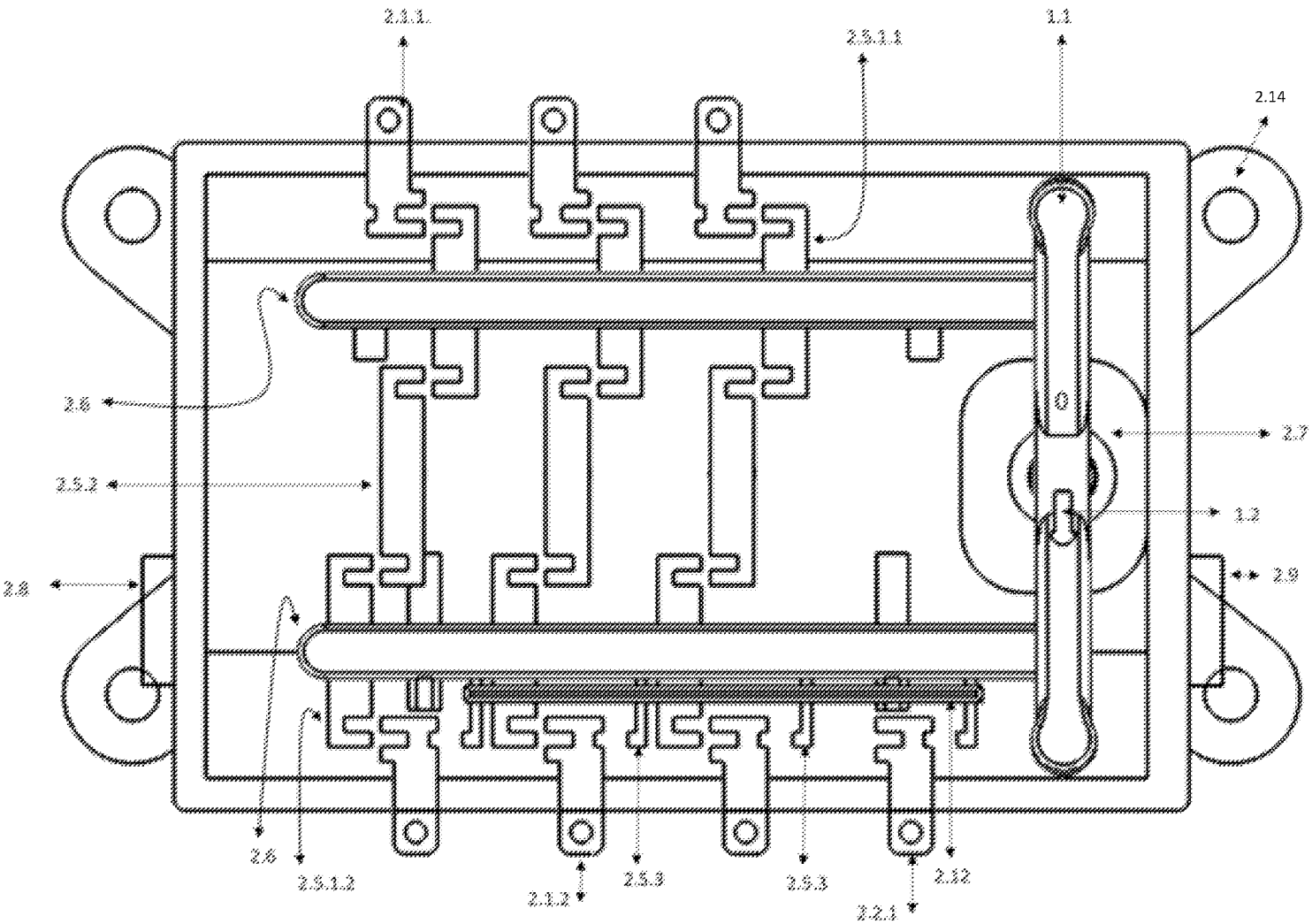
FIG. 2 shows a front internal view in position 0 of model A equipment.
Figure 3:
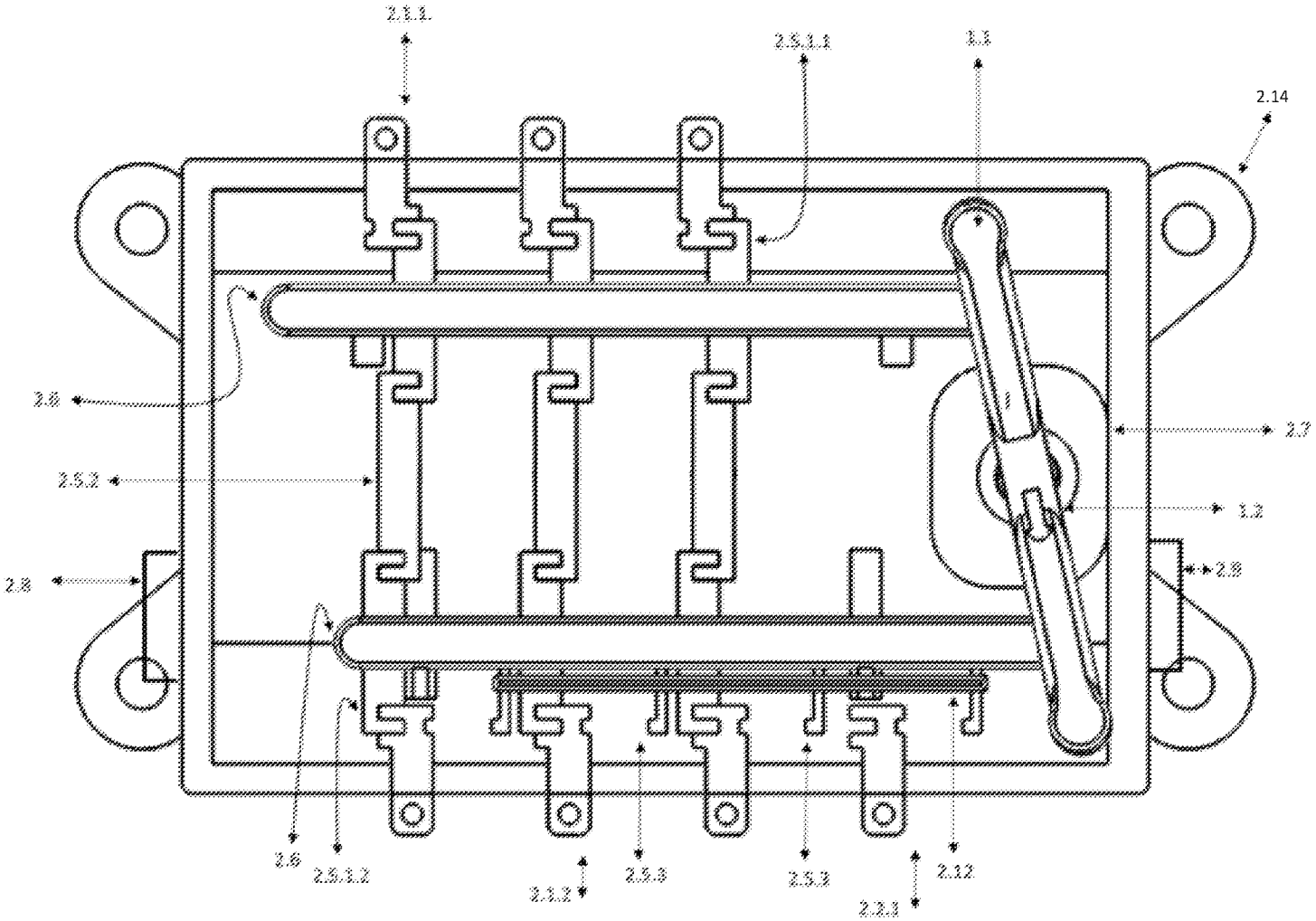
FIG. 3 shows a front internal view in position II of model A equipment.
Figure 4:
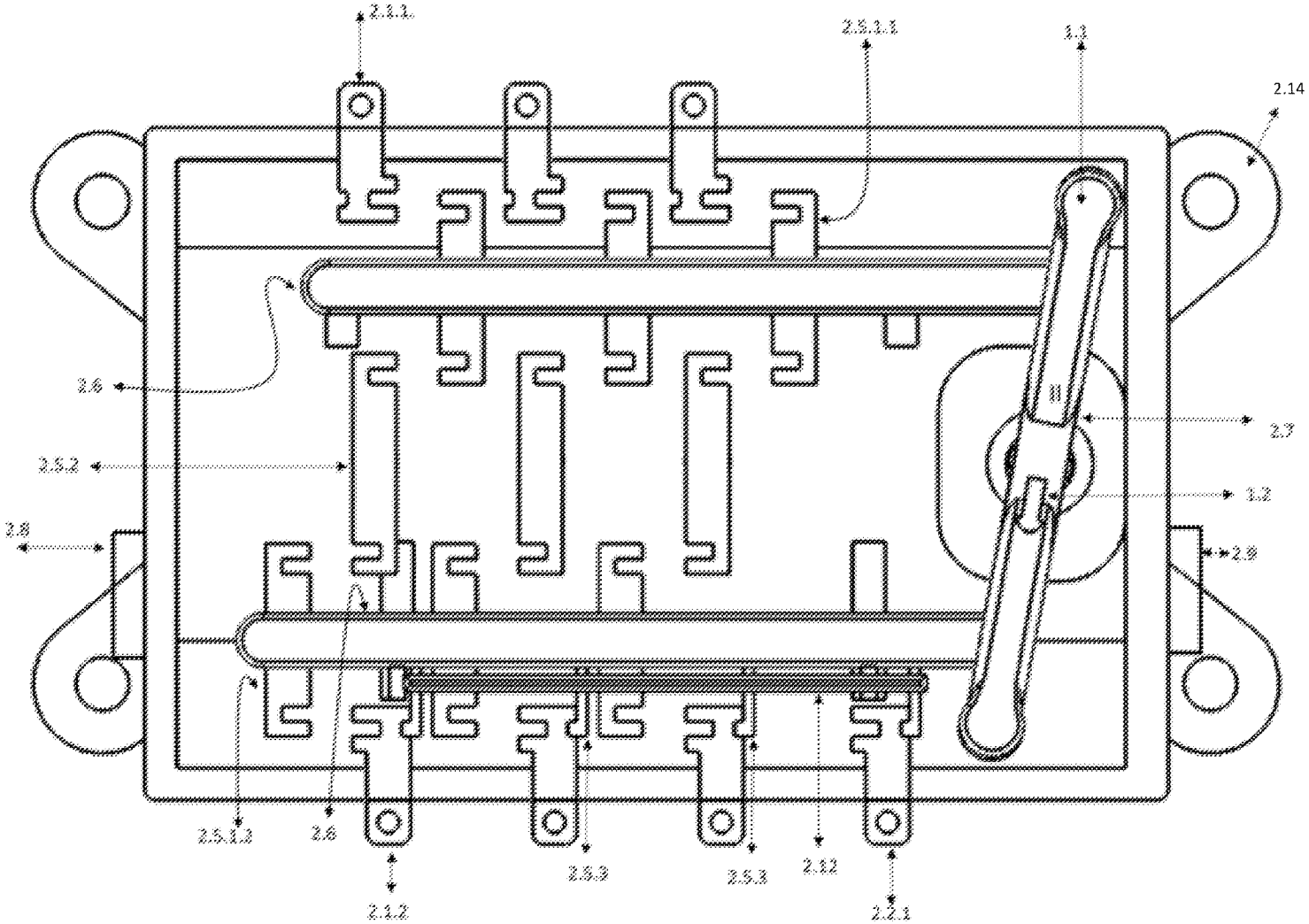
FIG. 4 shows a front internal view in position I of model A equipment.
Figure 5:
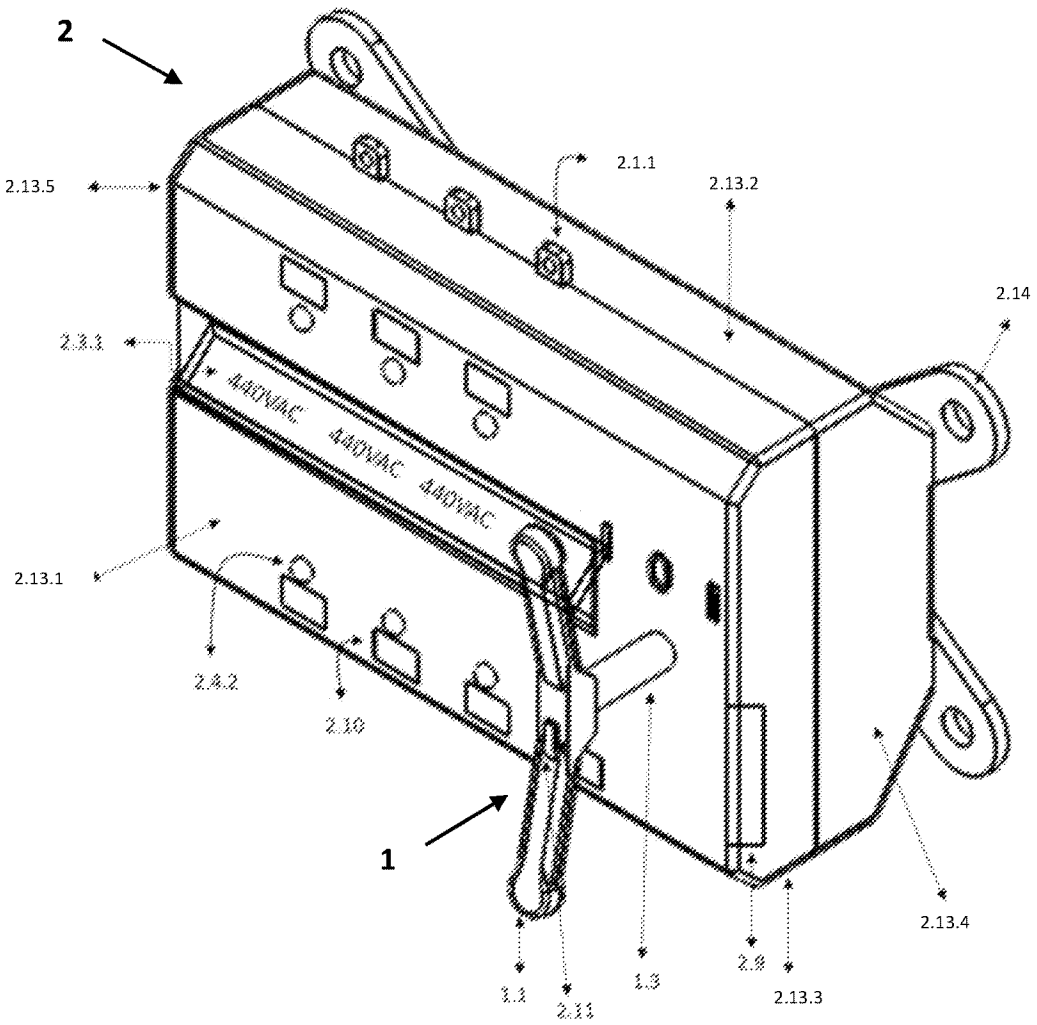
FIG. 5 shows an isometric view of model A equipment.
Figure 6:
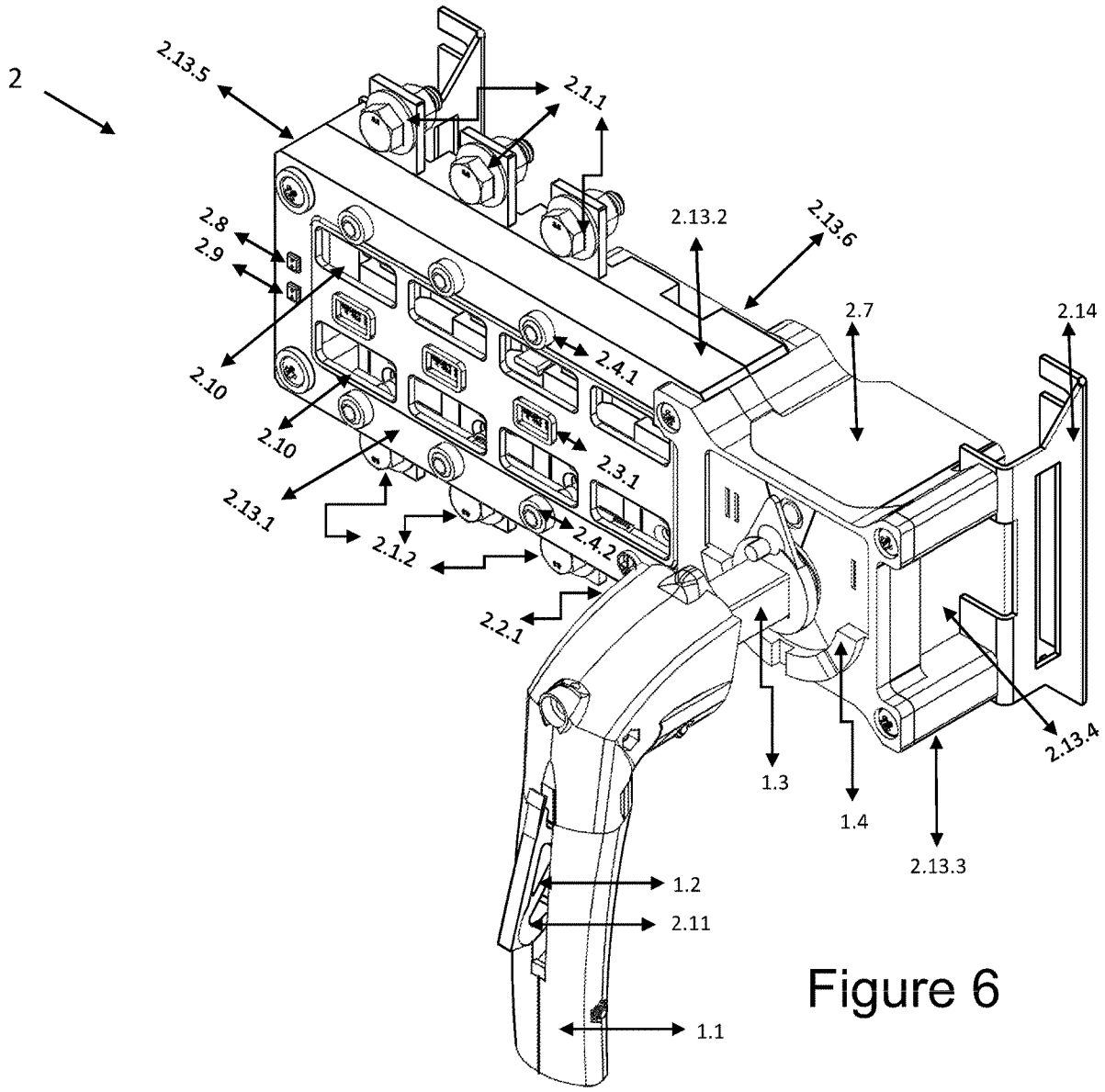
FIG. 6 presents an isometric view of another embodiment of the invention.

In a preferred embodiment of the invention and according to FIGS. 1 to 5, the invention comprises the following essential elements: a control (1) linked to a body (2), wherein the control (1) comprises a gripping mechanism (1.1), locking mechanism (1.2), extension rod (1.3) and switch position indicator label (1.4).

The body (2) is made up of: voltage terminals (2.1) which are divided into voltage input terminals or input electrical conductors (2.1.1) and voltage output terminals or output conductors (2.1.2); grounding terminals (2.2) which include the fixed grounding terminals (2.2.1); a display of electrical variables (2.3) which incorporates a display (2.3.1), it also incorporates a connection accessory (2.3.2); voltage indicator lights (2.4) divided into upper indicator lights (2.4.1) and lower indicator lights (2.4.2); internal poles (2.5) which are divided into internal movable poles (2.5.1) which include the input movable poles or internal input movable conductors (2.5.1.1) and the output movable poles or internal output movable electric conductors (2.5.1.2), these internal poles (2.5) also include the transition poles or transition electric conductors (2.5.2) and the internal grounding poles or grounding electrical conductors (2.5.3); a shaft for driving the movement of the internal poles (2.6); a force transmission system (between control and body) (2.7);

auxiliary electric contacts for position indication (2.8); pre-cutting electrical contacts (2.9); peepholes (2.10) for viewing the movable internal poles (2.5); an element for electrical labelling location (2.11); an electrical grounding short-circuit conductor (2.12); covers (2.13) including a front cover (2.13.1), an upper cover (2.13.2), a lower cover (2.13.3), a right side cover (2.13.4), a left side cover (2.13.5), a rear cover (2.13.6), all interconnected with each other; and fastening elements (2.14).

An even more detailed description of each of these essential elements follows.

Control (1)

The control (1) consists of a group of elements that interact to operate and control the equipment.

Gripping Mechanism (1.1)

In one embodiment of the invention, the gripping mechanism (1.1) may be a handle or other, which is an element for operating the load break switch in its three mutually exclusive positions II-0-1 (2-0-1). The handle (1.1) is interconnected to an extension mechanism (1.3) or directly to the body 2.

Position II or 2 (energized circuit). Current flow from source to load through input voltage terminals (2.1.1), transition poles or conductors (2.5.2), input internal movable electric poles or conductors (2.5.1.1), output movable poles or conductors (2.5.1.2) and output terminals (2.1.2). In this position the input terminals (2.1.1) are connected to the transition poles (2.5.2) to the internal input movable poles (2.5.1.1), in turn, the internal transition poles (2.5.2) are connected to the output terminals (2.1.2) to the output movable poles (2.5.1.2). In this position the upper indicator lights (2.4.1) and the lower indicator lights (2.4.2) will be on, and the display (2.3.1) of the electrical quantities (2.3) will be on and showing the measured quantities.

Position 0 (open circuit). Opening of the circuit that suspends the passage of electrical energy to the load, i.e., the input terminals (2.1.1) are still connected to the power source, but internally they are disconnected from the transition poles (2.5.2), from the internal input movable poles (2.5.1.1), from the output movable poles (2.5.1.2) and from the output terminals (2.1.2). The upper indicator lights (2.4.1) will remain on while the lower indicator lights (2.4.2) will be off, the display (2.3.1) of the electrical quantities (2.3) will be lit and showing the values of the measured quantities.

Position I or 1 (grounded circuit). The input terminals (2.1.1) remain connected to the power source but internally remain disconnected from the internal input movable poles (2.5.1.1), the output movable poles (2.5.1.2) and the output terminals (2.1.2); however, in this position the internal electrical grounding poles (2.5.3) and the output terminals (2.1.2) remain disconnected. 2); however, in this position the internal electrical grounding poles or conductors (2.5.3) and the output terminals (2.1.2) allow the connection between the output terminals (2.1.2) with the grounding terminal (2.2.1) through the electrical grounding short-circuit conductor (2.12). The voltage indicator lights (2.4.1) (2.4.2) and the display (2.3.1) will be as described in position 0.

Locking Mechanism (1.2)

In one embodiment of the invention, the locking mechanism (1.2) is a locking tab (1.2) which is an accessory allowing the installation of a padlock locking the complete equipment, the purpose of which is to prevent switching from the locked position to another, i.e., preventing untimely resetting. The locking mechanism (1.2) is then embedded in and goes through the handle (1.1) or in the body (2) of the load break switch.

Extension Mechanism (1.3)

In one embodiment of the invention, the extension mechanism (1.3) is an extension rod (1.3) which is a rigid attachment that allows the connection and transmission of force from the handle (1.1) to the force transmission system (2.7), which will allow the drive shaft (2.6) to move.

Position Indicator Label (1.4)

In one embodiment of the invention, the position indicators (1.4) are switch position indicator labels (1.4) which are elements that indicate whether the switch is energized, de-energized or grounded. The position indicators (1.4) are interconnected to the handle (1.1), or to the body (2) and optionally to an electrical panel.

Body (2)

The body (2) consists of a group of main elements which are part of the load break switch equipment, and with their interaction, control the passage of power, the physical display of the internal poles of the load break switch, the movement of the internal poles and their interaction with the input and output terminals, the visual indication by means of indicator lights, the measurement of electrical quantities and the visual inspection of the internal position of the poles by means of peepholes.

External Electrical Terminals or Conductors (2.1)

In one embodiment of the invention, the electrical conductors (2.1) are metallic terminals for connection to electrical voltage, which are electrical energy conductors that are divided into input electrical terminals or conductors (2.1.1) and output electrical terminals or conductors (2.1.2).

Electrical Input Terminals or Conductors (2.1.1)

The input terminals or electrical conductors (2.1.1) are power connection points, conductors of electrical energy. The input terminal (2.1.1) is the connection point between the power source and the load break switch. In the invention, the input terminals (2.1.1) at one end connect to the power source and at the other end to the input movable pole (2.5.1.1) provided the load break switch is in position II or energizing position.

Electrical Output Terminals or Conductors (2.1.2)

In one embodiment of the invention, the voltage output terminals (2.1.2) are connection points, conducting electrical energy, from the load break switch to the load or distribution system. In the invention, the voltage output terminals, or electrical conductors (2.1.2) at one end connect to the load and at the other end to the output movable pole (2.5.1.2) if the load break switch is in position II or energizing position. The output terminals (2.1.2) can also connect the load to the grounding system of the electrical infrastructure through the internal electrical grounding poles or conductors (2.5.3), the fixed electrical grounding terminal or conductor (2.2.1) and the electrical grounding short-circuit conductors (2.12) provided that the load break switch is in position I or grounding circuit position. If the load break switch is in position 0 the output terminals (2.1.2) are connected only to the de-energized electrical load.

For purposes of understanding the invention, a load refers to any electrical or electronic element that requires electrical energy to operate, for example, a capacitor, a resistor, a motor, an electrical protection, a variable speed drive, an electrical transformer, and electrical motor control center, an electrical distribution system. etc.

Terminals or Electrical Grounding Conductors (2.2)

In one embodiment of the invention, the electrical conductors (2.2) are grounding terminals (2.2) which are electrically conductive and allow connection of the equipment to the grounding system.

In the invention, the grounding terminals (2.2) comprise fixed grounding terminals (2.2.1) which at one end are connected to the internal electrical grounding poles or conductors (2.5.3) if the load break switch is in position I, or grounding circuit position, and at the other interconnected with the grounding system of the electrical infrastructure external to the load break switch.

Fixed Electrical Grounding Terminals or Conductors (2.2.1)

In one embodiment of the invention, the fixed grounding terminals (2.2.1) are electrically conductive and act as a connection point between the electrical grounding installation and the body (2) of the equipment, and when the equipment is in position I, allow short-circuit connection between the electrical grounding installation and the voltage output terminals (2.1.2) through the electrical grounding short-circuit conductor (2.12) which in turn is connected to the internal grounding poles (2.5.3).

Electrical Variables Display (2.3)

In one embodiment of the invention, the display (2.3) is a device for measuring electrical variables or magnitudes. This element comprises a display (2.3.1) and connection accessories (2.3.2).

The display of magnitudes and electrical variables (2.3) can be built into the body (2) or can be an accessory to be connected remotely.

Display (2.3.1)

The display (2.3.1) is a surface for numerical display of information, located in the body (2) in one of the load break switch covers, which will show the measurement of the electrical magnitudes.

The display (2.3.1) is connected by means of connection cables to the output terminals (2.1.2) for acquiring the electrical magnitude measurement signal; and to the input terminals (2.1.1) that provide the power supply or energize the display (2.3.1).

Electrical Variables Display Connection Accessory (2.3.2)

The electrical variables display connection accessory (2.3.2) is a group of cables for the connection between the display (2.3.1) and the power source used to energize the display.

The connection accessory of the electrical variables display (2.3.2) is connected to the input terminals (2.1.1) from where it receives the power to turn on the display (2.3.1), it is also connected to the output terminal (2.1.2) from where it takes the measurement of the magnitudes to be measured and takes them to the display (2.3.1).

Indicator Lights (2.4)

In one embodiment of the invention, the indicator lights (2.4) are voltage indicators which correspond to lights integrated in the body (2) of the load break switch equipment which will indicate whether there is presence or absence of voltage.

When voltage is present, the indicator light will be on and when voltage is absent it will be off. The voltage indicator lights (2.4) are upper (2.4.1) and lower (2.4.2).

The upper indicator lights (2.4.1) are interconnected to the input terminal (2.1.1); and the lower indicator lights (2.4.2) are interconnected to the output terminal (2.1.2); and both are recessed in the front cover (2.13.1) or in either body cover (2) of the load break switch.

Poles or Internal Electrical Conductors (2.5)

In one embodiment of the invention, the internal electrical conductors, or internal poles (2.5) which are conductors of electrical energy allow opening or closing of circuits for the passage of electrical current or the output terminals (2.1.2) grounding.

The inner movable poles (2.5) belong to the group consisting of inner movable poles (2.5.1), transition poles (2.5.2) and internal grounding poles or electric conductors (2.5.3). In turn, the internal movable poles (2.5.1) belong to the group consisting of internal input movable poles (2.5.1.1) and internal output movable poles (2.5.1.2).

Input Movable Electric Poles or Conductors (2.5.1.1)

The input movable poles or conductors (2.5.1.1) are internal mobile connectors, electrically conductive, which allow the closing or opening of the circuit between the input and output terminals (2.1.1) (2.1.2) through the transition poles (2.5.2) depending on the position of the control (1).

The input movable poles (2.5.1.1) are connected to the motion drive shaft of the internal poles (2.6), the input terminal (2.1.1) and the transition pole (2.5.2) depending on the position of the control.

Output Movable Electric Poles or Conductors (2.5.1.2)

The output movable poles (2.5.1.2) are internal mobile connectors, electrically conductive, which allow the circuit to be closed or opened between the transition poles (2.5.2) and the output and input terminals (2.1.2) (2.1.1) depending on the position of the control (1).

The output movable poles (2.5.1.2) are connected to the motion drive shaft of the internal poles (2.6) and depending on the position of the control (1) will be connected to the transition poles (2.5.2), and to the output terminals (2.1.2).

Transition Poles or Transition Conductors (2.5.2)

The transition poles (2.5.2) are fixed internal power conduction connectors that serve as an interconnection point between the input movable poles (2.5.1.1) and the output movable poles (2.5.1.2) when the control (1) is in position II of energizing to load. The transition poles (2.5.2) are located inside the load break switch body (2).

Internal Electrical Grounding Poles or Conductors (2.5.3)

The internal electrical grounding poles or conductors (2.5.3) are movable connectors which conduct electrical energy short-circuited by the electrical grounding short-circuit conductor (2.12), which are located inside the body 2, and which in the grounded position (position I or 1) of the control (1), will be connected to the output terminals (2.1.2) and to the fixed grounding terminal (2.2.1) allowing these to be short-circuited through the electrical grounding short-circuit conductor (2.12).

Drive Shaft (2.6)

In one embodiment of the invention, this element corresponds to the internal pole motion drive shaft (2.6) which is a transverse shaft in dielectric material that allows movement of the internal poles in positions I or 1 energized, 0 open, II or 2 grounded. It moves the internal input (2.5.1.1), output (2.5.1.2) movable poles.

The internal pole motion drive shaft (2.6) is interconnected with a force transmission mechanism (2.7) corresponding to a motion transmission system (2.7); and this motion transmission system (2.7) is interconnected with the extension mechanism (1.3).

Furthermore, the internal pole motion drive shaft (2.6) is interconnected with the input movable poles (2.5.1.1), and the output movable poles (2.5.1.2).

Force Transmission Mechanism (2.7)

In one embodiment of the invention, the force transmission mechanism (2.7) is a force transmission system (between handle (1) and body (2)) which is the motion transmission system between the handle (1.1) and the drive and motion shaft (2.6). This system can be operated manually with the handle or gripping mechanism (1.1) and makes the transfer of force by a mechanical system or by a motorized system.

The force transmission system (2.7) is interconnected to the extension mechanism (1.3) and interconnected to the internal pole motion drive shaft (2.6).

Auxiliary Electrical Contacts for Position Indication (2.8)

In one embodiment of the invention, the auxiliary electrical contacts (2.8) are auxiliary contacts for position indication (2.8) which are defined as elements connected to the body (2) which will allow the identification through dry contact of the position of the input movable poles (2.5.1.1) and the output movable poles (2.5.1.2).

The auxiliary contacts for position indication (2.8) are interconnected to the body (2) at one of its 6 covers; and are interconnected to the drive shaft of the internal poles (2.6).

Pre-Cutting Electrical Contacts (2.9)

In one embodiment of the invention, the pre-cutting electrical contacts (2.9) which are defined as dry output contacts connected to the body (2) and to the position of the drive shaft of the internal poles (2.6). This will allow obtaining an output to make an energy pre-shortcut to the load if the user wishes. It should be noted that the equipment can be capable of opening under load.

Peepholes for Movable Pole Display (2.10)

In one embodiment of the invention, the displays (2.10) are peepholes for viewing the movable pole (2.10) defined as small upper and lower perforations in the front cover (2.13.1) which will allow physical viewing of the positions of the input movable poles (2.5.1.1), output movable poles (2.5.1.2) and internal electrical grounding poles or conductors (2.5.3).

Element for Electrical Labelling Location (2.11)

In one embodiment of the invention, the element (2.11) is an electrical labelling attachment tab (2.11) which is defined as a tab embedded in the handle (1.1) or in the body (2), in which an electrical switch or hazard demarcation card may be placed.

Electrical Grounding Short-Circuit Conductor (2.12)

In one embodiment of the invention, the electrical grounding short-circuit conductor (2.12) is a metallic grounding short-circuit piece (2.12) which is defined as a piece in electrically conductive material and which in the grounded position I or 1 of the control (1) allows the short-circuiting of the output fixed terminals (2.1.2) with the fixed grounding terminal (2.2.1) through the internal grounding poles (2.5.3) and the electrical grounding short-circuit conductor (2.12), allowing the system downstream of the load break switch to be robustly grounded.

Covers (2.13)

The covers (2.13) are the external contour of the device that forms the body (2) they are built in a dielectric material and covers all the internal parts, poles, terminals, etc. The covers include the front cover (2.13.1), the top cover (2.13.2), the bottom cover (2.13.3), the right-side cover (2.13.4), the left side cover (2.13.5) and the rear cover (2.13.6). All the covers (2.13) are joined together to form the housing which provides protection for the components inside.

Fasteners (2.14)

The fastening elements (2.14) are elements that allow the device to be fixed by the rear cover (2.13.6) to a surface where it is to be anchored or fixed; this can be done by means of screws as an option, but it is not a limitation.

Unexpected Technical Effects

The technical effects and advantages achieved with the present invention are as follows:

- 100% compliance with the five golden rules of electrical safety from a single piece of equipment.
- Avoid personnel interaction with energized parts, opening of electrical panels and direct interaction with external electrical infrastructure.
- Reduction of time and costs in the maneuvers required to establish an electrically safe area at zero voltage and with grounding of all conductors in the area to be intervened.
- Mitigation of the risk of people in electrical maneuvers when implementing the procedure of the 5 golden rules of electrical safety and ensuring that the installation is in safe electrical conditions and insulation (0V voltage) for intervention.

Integrated equipment that allows to implement the procedure of the five golden rules of electrical safety, allowing to establish a safe electrical isolation system.

Ensuring that all the equipment's downstream electrical circuits are grounded, thereby mitigating the risk of backflows.

It avoids unexpected resetting as the equipment will allow it to be locked in any of the three positions.

Task reduction for the establishment of the 5 golden rules for electrical safety in low voltage activities in overhead electrical networks.

Easy verification of the load break switch's internal poles position through the peepholes that allow a clear and direct visualization.

Redundant validation of voltage absence by means of an electrical quantity meter and indicator lights without the use of external equipment and without the need for direct measurement by the operator.

The invention claimed is:

1. An electrical load break switch equipment with three mutually exclusive positions including position II, position 0, and position I, position II energizes a load circuit of an electric infrastructure, position 0 de-energizes the load circuit, and position I grounding a ground circuit to ground the load circuit, the ground circuit connected downstream of the load circuit; with application to the electrical infrastructure for electrical safety procedure and compliance with 5 golden rules of electrical safety via a single one of the switch equipment and without making direct intervention to the electrical infrastructure, said switch equipment comprising:

a control (1) interconnected to a body (2), the control (1) comprising: a gripping mechanism (1.1) interconnected with an extension mechanism (1.3) or directly to the body (2); a locking mechanism (1.2) embedded within the gripping mechanism (1.1) or in the body (2); and position indicator labels including II, 0, and I (1.4) interconnected to the gripping mechanism (1.1) or to the body (2), and the body (2) comprising:

a group of external electrical conductors or terminals (2.1.1), (2.1.2), (2.2.1);

a group of internal electrical conductors or poles (2.5.1), (2.5.1.1), (2.5.1.2), (2.5.2), (2.5.3), (2.12), wherein the electrical conductors (2.1.1), (2.1.2) are interconnected with displays of electrical quantities (2.3), wherein the displays (2.3) are embedded in a cover of the body (2), wherein, if the switch equipment is in position 1, the electrical conductors or terminals (2.2.1) are interconnected with the electrical conductors or poles (2.5.3) and with an electrical grounding short circuit conductor (2.12);

indicator lights (2.4.1), (2.4.2) interconnected with the electrical conductors (2.1.1) and (2.1.2) respectively, the indicator lights are embedded in the cover of the body (2);

electrical conductors (2.5.1.1) and (2.5.1.2) interconnected with a drive shaft (2.6), the drive shaft (2.6) interconnected with a force transmission mechanism (2.7); the force transmission mechanism (2.7) interconnected with the extension mechanism (1.3), and the extension mechanism (1.3) interconnected to the gripping mechanism (1.1);

electrical contacts (2.8), (2.9) interconnected with the drive shaft (2.6);

peepholes for viewing movable poles (2.10) embedded in the body (2); and an electrical labelling location (2.11) embedded in the gripping mechanism (1.1) or in the body (2).

2. The switch equipment according to claim 1, wherein the gripping mechanism (1.1) is a handle (1.1) interconnected to the extension mechanism (1.3), the extension mechanism (1.3) corresponding to an extension rod (1.3).

3. The switch equipment according to claim 1, wherein the locking mechanism (1.2) is a locking tab (1.2) embedded in and passing through the gripping mechanism (1.1) or embedded in the body 2.

4. The switch equipment according to claim 1, wherein the switch position indicator labels (1.4) are interconnected to the gripping mechanism (1.1).

5. The switch equipment according to claim 1, wherein the switch position indicator labels (1.4) are interconnected to an electrical panel or to the body (2).

6. The switch equipment according to claim 1, wherein the electrical conductors or terminals (2.1.1), (2.1.2) are external connection terminals (2.1), the external connection terminals (2.1) are grounding terminals (2.2.1), the electrical conductors or poles (2.5.1.1), (2.5.1.2), (2.5.2) and (2.5.3) are internal poles (2.5).

7. The switch equipment according to claim 1, wherein the displays (2.3) are displays for measuring electrical magnitudes (2.3) and the peepholes (2.10) are displays for viewing the movable pole (2.10), the peepholes (2.10) are embedded in the cover of the body (2).

8. The switch equipment according to claim 1, wherein the indicator lights (2.4.1), (2.4.2) are voltage presence indicator lights (2.4).

9. The switch equipment according to claim 1, wherein the drive shaft (2.6) corresponds to an internal pole motion drive shaft (2.6), and the drive shaft (2.6) is interconnected with a force transmission mechanism (2.7) corresponding to a motion transmission system (2.7), and the motion transmission system (2.7) is interconnected to the extension mechanism (1.3) and the extension mechanism (1.3) is interconnected to the gripping mechanism (1.1).

10. The switch equipment according to claim 1, wherein the electrical contacts (2.8) are the auxiliary contacts for position indication (2.8) and the electrical contacts (2.9) are the pre-cutting contacts (2.9).

11. The switch equipment according to claim 1, wherein the electrical labeling location (2.11) corresponds to an electrical labeling location tab (2.11) embedded in the gripping mechanism (1.1) or in the body (2).

12. The switch equipment, according to claim 1, wherein the voltage terminals (2.1) are of the group consisting of input terminals (2.1.1) and output terminals (2.1.2).

13. The switch equipment according to claim 1, wherein if the control (1) is in position II, then the input terminals (2.1.1) are interconnected at a first end with a power source and at a second end with poles (2.5.1.1), and the output terminals (2.1.2) are interconnected at a first end with an electrical load, and at a second end with a output movable pole (2.5.1.2).

14. The switch equipment according to claim 1, wherein if the control (1) is in position I, the grounding terminals (2.2) are fixed grounding terminals (2.2.1) including a first end interconnected to the poles (2.5.3) and a second end interconnected with the ground circuit downstream of the load circuit.

15. The switch equipment according to claim 1, wherein the display of electrical variables (2.3) may be at least one of is embedded in the body (2), embedded in a front cover (2.13.1) of the body (2), interconnected to the body (2), or displayed externally to the switch equipment.

16. The switch equipment according to claim 1, wherein the display for measured electrical variables (2.3) comprises of a display (2.3.1) and connection accessories (2.3.2).

17. The switch equipment according to claim 1, wherein the indicator lights (2.4.1), (2.4.2) are voltage presence indicator lights (2.4), wherein the voltage indicator lights (2.4) belongs to a group of upper indicator lights (2.4.1) and lower indicator lights (2.4.2).

18. The switch equipment according to claim 1, wherein the electrical conductors or poles (2.5.1.1), (2.5.1.2), (2.5.2) and (2.5.3) are internal poles (2.5), and wherein the internal poles (2.5) belong to a group of internal moving poles (2.5.1), transition poles (2.5.2), and poles (2.5.3).

19. The switch equipment according to claim 1, wherein the drive shaft (2.6) is an internal pole motion drive shaft (2.6) that is interconnected with the input movable poles (2.5.1.1), with the poles (2.5.1.2), and with the force transmission mechanism (2.7).

20. The switch equipment according to claim 1, wherein the drive shaft (2.6) is an internal pole motion drive shaft (2.6), and wherein the force transmission mechanism (2.7) is interconnected to the extension rod (1.3) and interconnected to the internal pole motion drive shaft (2.6).

21. The switch equipment according to claim 1, wherein the electrical contacts (2.8) are auxiliary contacts for position indication (2.8), and wherein the drive shaft (2.6) is an internal pole motion drive shaft (2.6), and wherein the auxiliary contacts for position indication (2.8) are interconnected to the body (2) and is interconnected to the internal pole motion drive shaft (2.6).

22. The switch equipment according to claim 1, wherein the drive shaft (2.6) is an internal pole motion drive shaft (2.6), and wherein the pre-cutting contacts (2.9) are interconnected to the body (2) and are interconnected to the internal pole motion drive shaft (2.6).

23. The switch equipment according to claim 1, wherein the peepholes for viewing the movable pole (2.10) are located in a front cover (2.13.1).

24. The switch equipment according to claim 1, wherein the tab for electrical labeling location (2.11) is a drilled hole located in the gripping mechanism (1.1) or in the body (2).

25. The switch equipment according to claim 1, wherein the electrical grounding short circuit conductor (2.12) is interconnected to the poles (2.5.3), and when the control (1) is in position 1, the electrical grounding short circuit conductor (2.12) is also interconnected with the terminal (2.1.2) and the terminal (2.2.1) through the poles (2.5.3).

26. The switch equipment according to claim 1, wherein an external surface of the body (2) is interconnected to a front cover (2.13).

27. The switch equipment according to claim 1, wherein the control (1) has three positions including position II, position 0, and position I; the three positions are mutually exclusive, wherein the control (1) may be positioned in one of the three positions using the force transmission system (2.7) and the drive shaft (2.6).

28. The switch equipment according to claim 1, wherein the control (1) has three positions including position II, position 0, and position I, wherein position II energizes the load circuit, position 0 opens the load circuit and position I grounds the ground circuit, the drive shaft (2.6) connected to the force transmission system (2.7) and the force transmission system connected to the extension mechanism (1.3) and interconnected to the control (1), wherein when changing from position II to position I, the control (1) must always pass through position 0, and when the control (1) is changing from position I to position II, the control (1) must always pass through position 0.

* * * * *